US007392777B2

(12) United States Patent
Faria et al.

(10) Patent No.: US 7,392,777 B2
(45) Date of Patent: Jul. 1, 2008

(54) VARIABLE VALVE TRAIN OF AN INTERNAL COMBUSTION ENGINE

(75) Inventors: Christof Faria, Erlangen (DE); Frank Himsel, Obermichelbach (DE)

(73) Assignee: Schaeffler KG, Herzogenaurach (DE)

( * ) Notice: Subject to any disclaimer, the term of this patent is extended or adjusted under 35 U.S.C. 154(b) by 121 days.

(21) Appl. No.: 11/505,667

(22) Filed: Aug. 17, 2006

(65) Prior Publication Data

US 2007/0044743 A1 Mar. 1, 2007

(30) Foreign Application Priority Data

Aug. 27, 2005 (DE) ..... 10 2005 040 649

(51) Int. Cl.
*F01L 1/18* (2006.01)

(52) U.S. Cl. ..... 123/90.39; 123/90.12; 123/90.44; 123/90.45; 123/90.16; 74/569

(58) Field of Classification Search ..... 123/90.16, 123/90.2, 90, 39, 90.44, 90.12, 90.13, 90.39, 123/90.41, 90.45, 90.48, 90.52, 90.55; 74/559, 74/567, 569

See application file for complete search history.

(56) References Cited

U.S. PATENT DOCUMENTS 3,809,033 A 5/1974 Cartledge
4,523,551 A 6/1985 Arai et al.
6,422,186 B1 7/2002 Vanderpoel
6,925,976 B2 * 8/2005 Israel et al. ..... 123/90.12
2002/0066428 A1 6/2002 Kammerdiener et al.
2004/0231639 A1 11/2004 Irael et al.

* cited by examiner

*Primary Examiner*—Ching Chang
(74) *Attorney, Agent, or Firm*—Charles A. Muserlian

(57) ABSTRACT

The invention proposes a variable valve train (1) for a gas exchange valve (8) of an internal combustion engine, which gas exchange valve (8) is actuated by a cam (2), said valve train (1) comprising a force transmission device (4) that is arranged between the cam (2) and the gas exchange valve (8) and includes a hydraulic lifting device (9) comprising a pressure piston (10) that is arranged for longitudinal displacement in a cylinder (12), said pressure piston (10) defining a pressure chamber (13) that is connected to a pressure medium supply of the internal combustion engine and said pressure piston (10) permitting, under high-pressure loading, an actuation of the gas exchange valve (8) independently of the cam (2). The force transmission device (4) is configured as an oscillating lever or rocker arm (3) mounted for pivoting on a lever shaft (6) comprising a longitudinal channel (14) that transports pressure medium and acts as a link (15) between the pressure medium supply and the pressure chamber (13).

3 Claims, 2 Drawing Sheets

VARIABLE VALVE TRAIN OF AN INTERNAL COMBUSTION ENGINE

FIELD OF THE INVENTION

The invention concerns a variable valve train for a gas exchange valve of an internal combustion engine, which valve is actuated by a cam and biased by a closing spring against the opening direction. The valve train comprises a force transmission device that is arranged between the cam and the gas exchange valve and comprises a hydraulic lifting device comprising a pressure piston that is arranged for longitudinal displacement in a cylinder. The pressure piston defines a pressure chamber that is connected to an adjustable pressure medium supply of the internal combustion engine and permits, under high-pressure loading, a hydraulic actuation of the gas exchange valve independently of the cam, against the force of the closing spring.

BACKGROUND OF THE INVENTION

Valve trains of a generic type in which the lift of the gas exchange valve is the result of the superposition of a mechanical lift caused by the cam and a variably adjustable lift of a hydraulic lifting device that acts independently of the cam on the movement of the gas exchange valve, are known in the prior art. Thus, for example, DE 101 56 309 A1 describes a cup tappet valve train comprising a hydraulic lifting device. This comprises a pressure piston that is arranged between in inner side of the cup bottom and the valve stem and actuates the gas exchange valve relative to the cup tappet as a function of the change of volume of a pressure chamber defined by the pressure piston. The pressure chamber, in its turn, is connected through channels in the interior of the cup tappet and in the tappet guide of the internal combustion engine to a hydraulic medium supply whose pressure and volume stream can be adjusted in conformance with the point of operation.

As alternatives to the aforesaid cup tappet, the cited document proposes further force transmission devices that are known to the person skilled in the art on the one hand, as stationary support elements arranged in the internal combustion engine for mounting a tilting valve lever and, on the other hand, as a tappet, for example, of a pushrod valve train, guided longitudinally in the internal combustion engine for loading valve levers. Insofar, the aforesaid document does not provide any incentives that would occasion a person skilled in the art to also apply such hydraulic lifting devices in valve train architectures other than those named above.

OBJECTS OF THE INVENTION

It is an object of the invention to provide a variable valve train of the pre-cited type in which the cited drawbacks are eliminated using simple measures. It is a further and particular object of the invention to widen the known but considerably restricted field of use of hydraulic lifting devices to include modern valve train architectures.

These and other objects and advantages of the invention will become obvious from the following detailed description.

SUMMARY OF THE INVENTION

The invention achieves the above objects by the fact that the force transmission device is configured as an oscillating lever or rocker arm mounted for pivoting on a lever shaft that comprises a longitudinal channel that transports pressure medium and acts as a link between the pressure medium supply and the pressure chamber.

The subject matter of the present invention is therefore an oscillating lever or rocker arm valve train mounted on a lever shaft and enabling the mechanical lift of the cam and a hydraulically produced lift, that is independent from the cam, to be superimposed on the gas exchange valve. Besides a far-reaching freedom of modifying the cam-defined inflexible lift of the gas exchange valve, the intention of the invention is to enable a secondary lift of the gas exchange valve during a lift-free base circle phase of the cam. Such a secondary lift opens up advantageous possibilities of internal exhaust gas re-suction in large and exactly adjustable quantities.

This form of exhaust gas re-suction is, in particular, the basis for an operation of the internal combustion engine with a homogeneous and auto-igniting charge. A combustion process of this type, also called HCCI process (Homogeneous Charge Compression Ignition) can be used both in auto-ignited diesel internal combustion engines and in spark-ignited gasoline internal combustion engines mainly for the purpose of reducing emission, at least in part-load operation of the internal combustion engine. In the HCCI process, the pattern of combustion is determined mainly by controlling the composition and the temperature progression of the charge. It has been found that a high charge temperature is desirable for controlling ignition timing in this combustion process. A very effective means of raising the temperature of the charge is to increase the residual gas fraction in the cylinder charge, i.e. to increase the fraction of not expelled exhaust gas, or of expelled exhaust gas of the preceding combustion cycle that is returned to the cylinder for the next combustion cycle. An important requirement is that the residual gas fraction must be able to be adapted fully variably to the point of operation of the internal combustion engine, and this may require residual gas quantities in the order of 60% of the cylinder charge and more. Such large fractions of residual gas can no longer be made available through conventional valve overlap or through a device for external exhaust gas re-feed. Moreover, the HCCI process reacts with unacceptable combustion behavior extremely sensitively to changes in the properties of the charge. Thus, it is not only vital to make residual gas available in the required quantity but a cycle-conforming, highly precise dosage of the residual gas fraction individually adapted to each cylinder is likewise required and can be provided by the inventive oscillating lever or rocker arm valve train even in modern valve train architectures.

According to an advantageous embodiment of the invention, the pressure piston comprises a recess that is connected through at least one radial bore to an annular groove extending in an outer peripheral surface of the pressure piston. Depending on the lift position of the pressure piston relative to the cylinder, this annular groove communicates hydraulically with a pressure channel of the oscillating lever or rocker arm, which pressure channel is connected to the longitudinal channel of the lever shaft and opens into the cylinder, so that, when the pressure piston is in its fully retracted position, the recess is connected through the largest possible flow cross-section to the pressure channel, whereas, in the extended position of the pressure piston, the pressure channel is practically closed by the outer peripheral surface of the piston. In this way, the annular groove serves not only as a hydraulic connection between the pressure chamber and the pressure channel of the oscillating lever or rocker arm independently of the angular position of the pressure piston but also as a hydraulically acting control edge of the pressure piston. Due to the fact that the pressure channel is gradually closed by the outer peripheral surface of the pressure piston during its outward motion, this control edge enables a self-controlling lift pattern of the pressure piston that is almost independent of the pressure level of the pressure medium supply. The thus decreasing flow cross-section between the pressure channel and the annular groove leads to an increasing throttling of the volume stream into the pressure chamber till this stream is almost completely shut off. In this way, it is possible to generate, in a passive manner, a lift pattern of the pressure piston that, under constant pressure in the pressure medium supply is characterized by a high initial acceleration, followed by a retardation phase till the maximum lift of the pressure piston is reached. On the one hand, this enables a considerable simplification of the regulating procedure for controlling the pressure medium supply and, on the other hand, the mechanical loading of an axial stop provided as a maximum-lift limitation for the pressure piston can be clearly reduced, especially in the case of a malfunctioning of the controls.

Finally, the hydraulic power take-up of the pressure medium supply that leads to an undesired frictional pressure rise in the internal combustion engine can be compensated for at least partially by the fact that for reducing friction in the valve train, the oscillating lever or rocker arm comprises a rotating and, optionally, rolling bearing-mounted roller acting as a low-friction running surface for the cam.

The invention will now be described more closely with reference to the appended drawings that illustrate an example of embodiment of the invention.

DETAILED DESCRIPTION OF THE DRAWINGS

Figure 1:
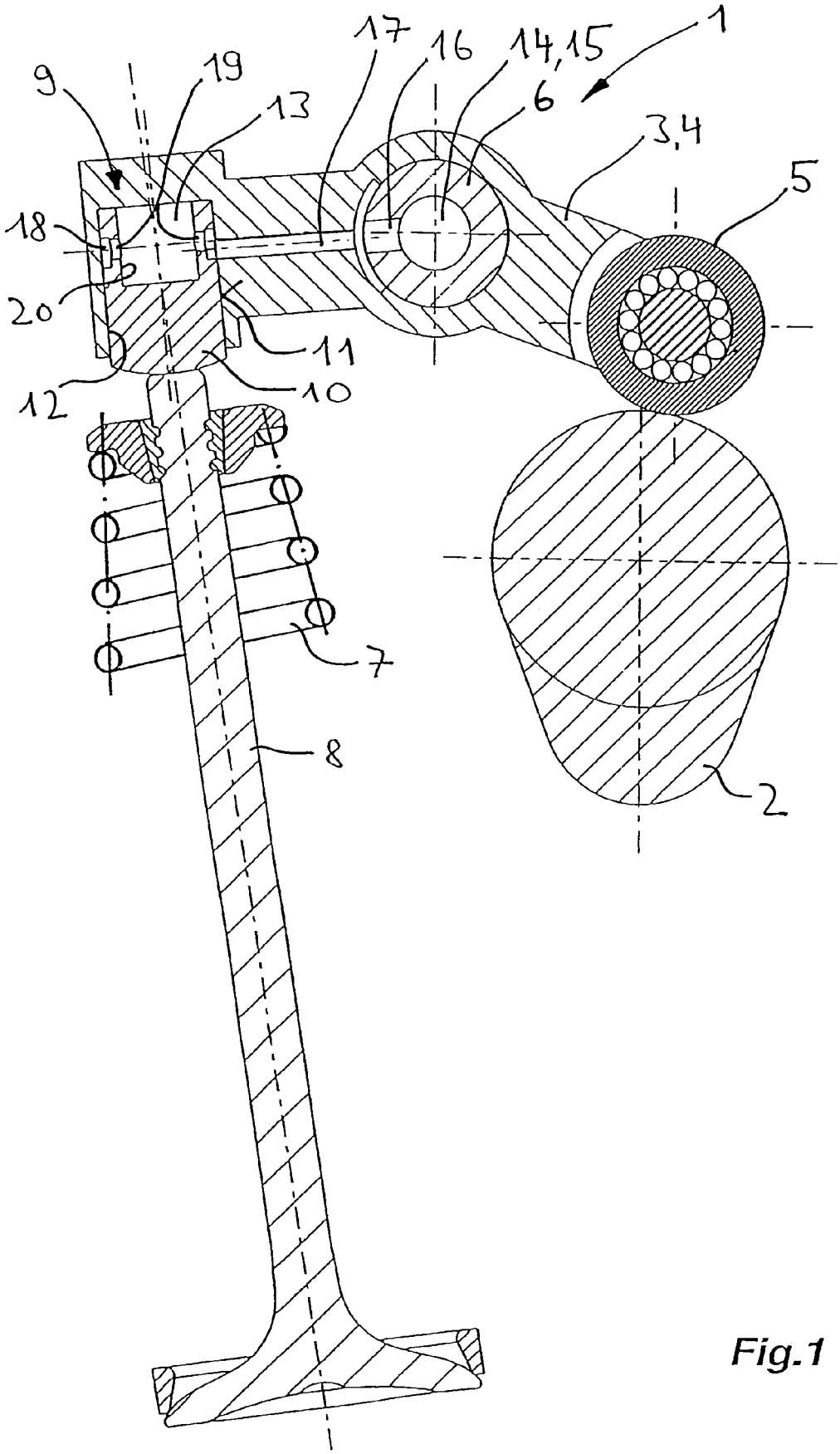
FIG. 1 shows a longitudinal section of a rocker arm valve train, in a retracted position of the pressure piston.

FIG. 1 discloses a valve train 1 of the invention for an internal combustion engine with reference to an example of a rocker arm valve train. The illustration shows a cam 2 of a camshaft, which cam 2 actuates a force transmission device 4, configured as a rocker arm 3, through a rolling bearing-mounted roller 5 that serves as a low-friction running surface for the cam 2. The rocker arm 3 is mounted for rotation, in a manner known, per se, on a lever shaft 6 and activates, at its cam-distal end, a gas exchange valve 8 that is biased by a closing spring 7 against the opening direction. The rocker arm 3 comprises a hydraulic lifting device 9 comprising a pressure piston 10 and enabling a variable opening pattern of the gas exchange valve 8 due to the fact that the mechanical lift produced by the cam 2 is overlayed with a hydraulically produced lift of the pressure piston 10 and then transmitted to the gas exchange valve 8. The pressure piston 10 is guided with an outer peripheral surface 11 for longitudinal displacement in a valve-proximate cylinder 12 of the rocker arm 3 and defines a pressure chamber 13 that is connected to an adjustable pressure medium supply, not shown, of the internal combustion engine. For this purpose, a longitudinal channel 14 transporting pressure medium extends in the lever shaft 6, which longitudinal channel 14 serves on the one hand, as a link 15 to the pressure medium supply and on the other hand, comprises a cross-bore 16 that is connected to a pressure channel 17 extending in the rocker arm 3 and opening into the cylinder 12. The hydraulic connection of the pressure chamber 13 to the pressure channel 17 is effected, finally, through an annular groove 18 that extends in the outer peripheral surface 11 of the pressure piston 10 and communicates through radial bores 19 with a recess 20 of the pressure piston 10.

Figure 2:
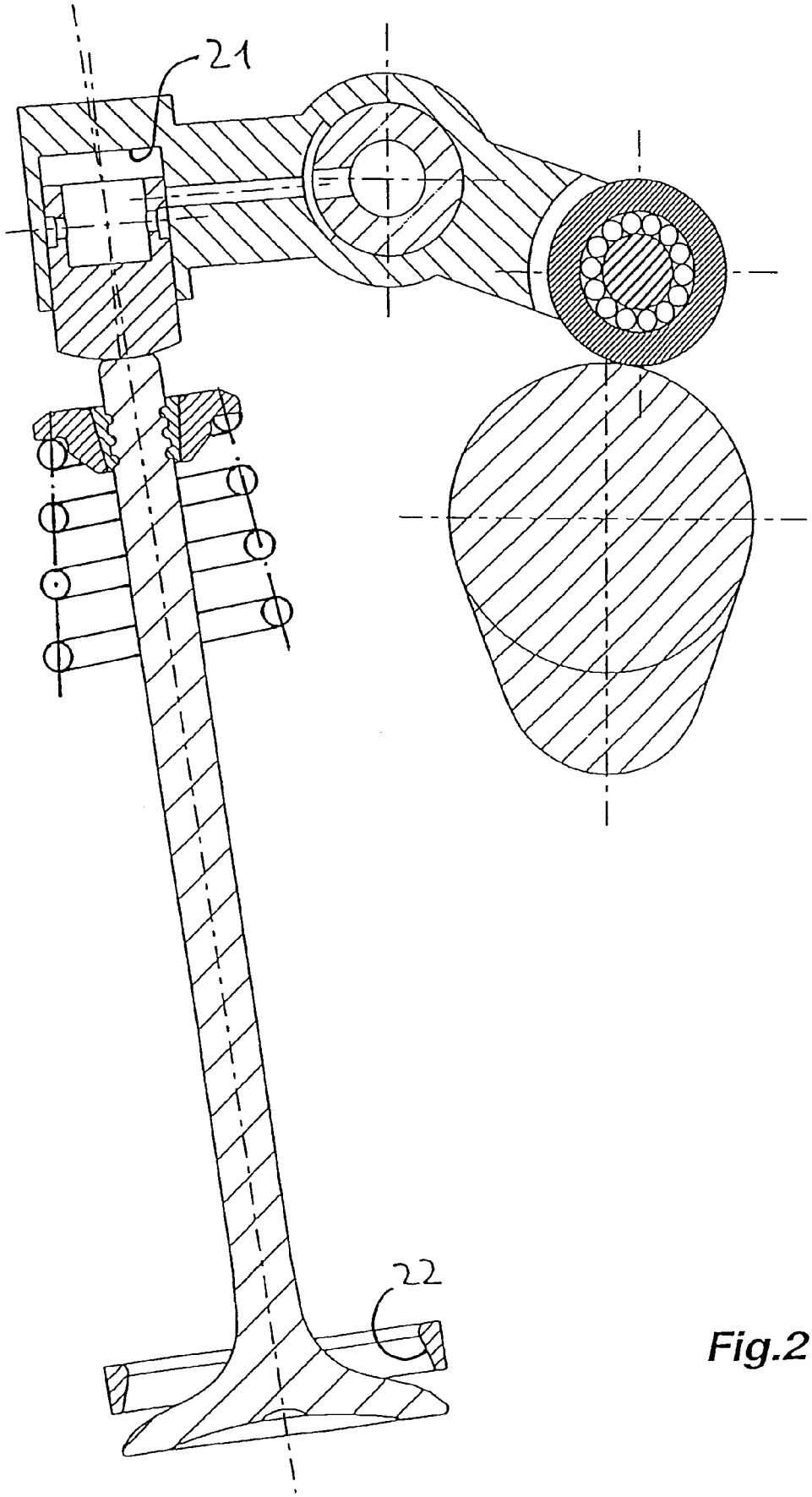
FIG. 2 shows the valve train of FIG. 1 in the extended state of the pressure piston.

A hydraulically produced secondary lift of the gas exchange valve 8 is described in the following with joint reference to FIGS. 1 and 2. The starting point is the state illustrated in FIG. 1 in which the gas exchange valve 8 is closed, the roller 5 is in contact with a lift-free base circle of the cam 2 and the pressure piston 10 is situated in a retracted position i.e., in contact with a bottom 21 of the cylinder 12. According to FIG. 2, an opening of the gas exchange valve 8 during the base circle takes place when the pressure piston 10 is loaded by hydraulic medium under high pressure and activates the gas exchange valve 8 against the force of the closing spring 7.

The timing, that is to say, the point of time of opening and closing of the hydraulically produced secondary lift depends in the first place on the pressure pattern of the hydraulic medium within the pressure medium supply. To configure this pressure pattern, it is possible, for example, to use a hydraulic valve integrated into the pressure medium supply. The function of this valve is to permit a volume stream of the hydraulic medium delivered by a high pressure pump to enter the pressure chamber 13 or block it from entering the pressure chamber 13 as a function of the point of operation and the cam angle. FIG. 2, in contrast, shows a pressure pattern configuration of the pressure piston 10 that is largely independent of the above pressure pattern. For this purpose, the annular groove 18 of the pressure piston 10 is configured and arranged so as to act, at the same time, as a control edge for the pressure channel 17. In the state shown in FIG. 1 in which the pressure piston 10 is retracted, the annular groove 18 and the pressure channel 17 are situated opposite each other with the largest possible overlap. Because the flow cross-section now available for the hydraulic medium between the pressure chamber 13 and the pressure channel 17 is at its largest in this position, the outward movement of the pressure piston 10 takes place with a high initial acceleration. In the further course of the lift, the pressure piston 10 is decelerated because the hydraulic medium volume stream into the pressure chamber 13 is throttled due to a gradually decreasing overlap between the annular groove 18 and the pressure channel 13 that reduces the flow cross-section. The maximum lift position of the pressure piston 10 illustrated in FIG. 2 is finally reached when the pressure channel 17 is almost completely closed by the outer peripheral surface 11 of the pressure piston 10. A mechanically defined maximum-lift limitation of the pressure piston 10 is realized through a stop means well known to the person skilled in the art and therefore not specifically shown in the figure.

A discontinuation of the secondary lift is initiated by the fact that the hydraulic medium volume situated in the pressure chamber 13 can be discharged into the then pressure-less or low-pressure pressure medium supply of the internal combustion engine. To limit the mechanical loading of the valve train and the setting-down noises, it can be appropriate to decelerate the pressure piston 10, shortly before it reaches the retracted position, to a permissible setting-down speed of the gas exchange valve 8 into a valve seat 22. One method of doing this is to regulate the volume stream of the hydraulic medium flowing out of the pressure chamber 13 into the pressure medium supply. Alternatively or additionally, a hydraulic brake as is known from hydraulic valve trains functioning according to the lost motion principle, can also be integrated into the pressure piston 10 and/or into the rocker arm 3.

Finally, in the general case of a multi-cylinder internal combustion engine, it is necessary to configure the pressure pattern in the pressure medium supply selectively for each cylinder as a function of the firing sequence of the internal combustion engine. For this purpose, a separate longitudinal channel 14 in the lever shaft 6 must be associated to each rocker arm 3 or to each rocker arm group of a cylinder. Thus, for example, the lever shaft 6 of an internal combustion engine with four in-line cylinders and a uniform firing interval of 180° crankshaft angle would comprise four separate longitudinal channels 14 that are connected selectively, depending on the cylinder in question, to the pressure chambers 13 of the corresponding rocker arms 3.

The invention claimed is:

1. A variable valve train for a gas exchange valve of an internal combustion engine, which gas exchange valve is actuated by a cam and biased against opening direction by a closing spring, said valve train comprising a force transmission device that is arranged between the cam and the gas exchange valve and includes a hydraulic lifting device comprising a pressure piston that is arranged for longitudinal displacement in a cylinder, said pressure piston defining a pressure chamber that is connected to an adjustable pressure medium supply of the internal combustion engine and said pressure piston permitting, under high-pressure loading, a hydraulic actuation of the gas exchange valve independently of the cam, against a force of the closing spring, wherein the force transmission device is configured as an oscillating lever or rocker arm mounted for pivoting on a lever shaft comprising a longitudinal channel that transports pressure medium and acts as a link between the pressure medium supply and the pressure chamber, the pressure piston comprises a recess that is connected through at least one radial bore to an annular groove extending in an outer peripheral surface of the pressure piston, as a function of a lift position of the pressure piston relative to the cylinder, this annular groove communicates hydraulically with a pressure channel of the oscillating lever or rocker arm, which pressure channel is connected to the longitudinal channel of the lever shaft and opens into the cylinder, so that, when the pressure piston is in a fully retracted position, the recess is connected through a largest possible flow cross-section to the pressure channel, whereas, in an extended position of the pressure piston, the pressure channel is practically closed by the outer peripheral surface of the piston.

2. A valve train of claim 1, wherein the oscillating lever or rocker arm comprises a rotating roller that acts as a low-friction running surface for the cam.

3. A valve train of claim 2, wherein the roller is mounted on a roller bearing.

* * * * *